US006964556B2

(12) United States Patent
Chiu et al.

(10) Patent No.: US 6,964,556 B2
(45) Date of Patent: Nov. 15, 2005

(54) SIDE-BLOWN FAN

(75) Inventors: Chun-che Chiu, Taipei (TW); Heng-yi Chen, Chiai (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 10/718,176

(22) Filed: Nov. 20, 2003

(65) Prior Publication Data

US 2004/0191060 A1 Sep. 30, 2004

(30) Foreign Application Priority Data

Mar. 31, 2003 (TW) ..... 92204948 U

(51) Int. Cl.[7] ..... F04D 29/42
(52) U.S. Cl. ..... 415/205; 415/206; 415/214.1
(58) Field of Search ..... 415/205, 206, 415/214.1, 102

(56) References Cited

U.S. PATENT DOCUMENTS 6,328,529 B1 * 12/2001 Yamaguchi et al. ..... 415/178
6,540,476 B2 * 4/2003 Huang et al. ..... 415/98
6,805,536 B2 * 10/2004 Hung ..... 416/244 R

* cited by examiner

*Primary Examiner*—Ninh Nguyen
(74) *Attorney, Agent, or Firm*—Pai Patent & Trademark Law Firm; Chao-Chang David Pai

(57) ABSTRACT

A side-blown fan is formed by a case and a blade member. The case includes a side-outlet, an axial inlet and a protrusion. The protrusion extends from an edge of the axial inlet toward the center of the axial inlet. The blade member is embedded in the inside of the case. In the radial direction, a high air pressure region exists between the blade member and the case. The protrusion covers the high air pressure region and a part of the blade member.

19 Claims, 4 Drawing Sheets

SIDE-BLOWN FAN

BACKGROUND OF THE INVENTION

1. Field of the Invention

The invention relates to a side-blown fan and, more particularly, to a side-blown fan with reduced air leakage and an increased air pressure.

2. Description of the Related Art

In a system requiring a high back pressure, a blower is conventionally used to provide a higher air pressure for the system so that a higher back pressure may be obtained in the system. FIG. 1 is a schematic illustration showing a conventional blower. Referring to FIG. 1, a blower 100 is constituted of an upper case 102*a*, a blade member 106 and a lower case 102*b*. The upper case 102*a* has an axial inlet 104, the lower case 102*b* has an axial inlet 110, and a high air pressure region 108 exists between the blade member 106 and the upper and lower cases 102*a* and 102*b*. In addition, a side-outlet 112 is formed when the upper case 102*a* and the lower case 102*b* are combined.

In the above-mentioned structure, the upper and lower cases 102*a* and 102*b* and an outer periphery of the blade member 106 defines a region serving as a flow field 114 for the blower 100. Since the upper and lower cases 102*a* and 102*b* almost do not cover the blade member 106, when the rotating speed of the blade member 106 is gradually increased, the air stream flowing in the flow field 114 tends to overflow from the inlets 104, 110, and pressure leakage and air leakage may occur. Accordingly, the air pressure cannot be further increased.

BRIEF SUMMARY OF THE INVENTION

It is therefore an object of the invention to provide a side-blown fan to greatly increase the operational air pressure.

To achieve the above-mentioned object, the invention provides a side-blown fan formed by a case and a blade member. The case includes a side-outlet, an axial inlet, and a protrusion extending from an edge of the axial inlet toward the center of the axial inlet. The blade member is embedded inside the case. A high air pressure region exists between the blade member and the case in a radial direction. The protrusion covers the high air pressure region and a part of the blade member.

Also, the side-blown fan of the invention may further include another axial inlet and another protrusion, which are formed on another side surface corresponding to the first axial inlet and the first protrusion. Furthermore, the case of the side-blown fan of the invention may also be constituted of a plurality of case elements.

In the side-blown fan of the invention, the protrusion covers the high air pressure region and a part of the blade member. Therefore, when the side-blown fan is in operation, the air traveling within the flow field of the side-blown fan will not overflow from the flow field, and the operational air pressure may be greatly increased.

In addition, in the side-blown fan of the invention, since the protrusion extends from the edge of the axial inlet toward the center, the dimension of the axial inlet is slightly reduced. However, the operational air pressure may be greatly increased within the range of the specific air flow.

Other objects, features, and advantages of the invention will become apparent from the following detailed description of the preferred embodiment with reference to the accompanying drawings.

DETAILED DESCRIPTION OF THE INVENTION

Figure 1:
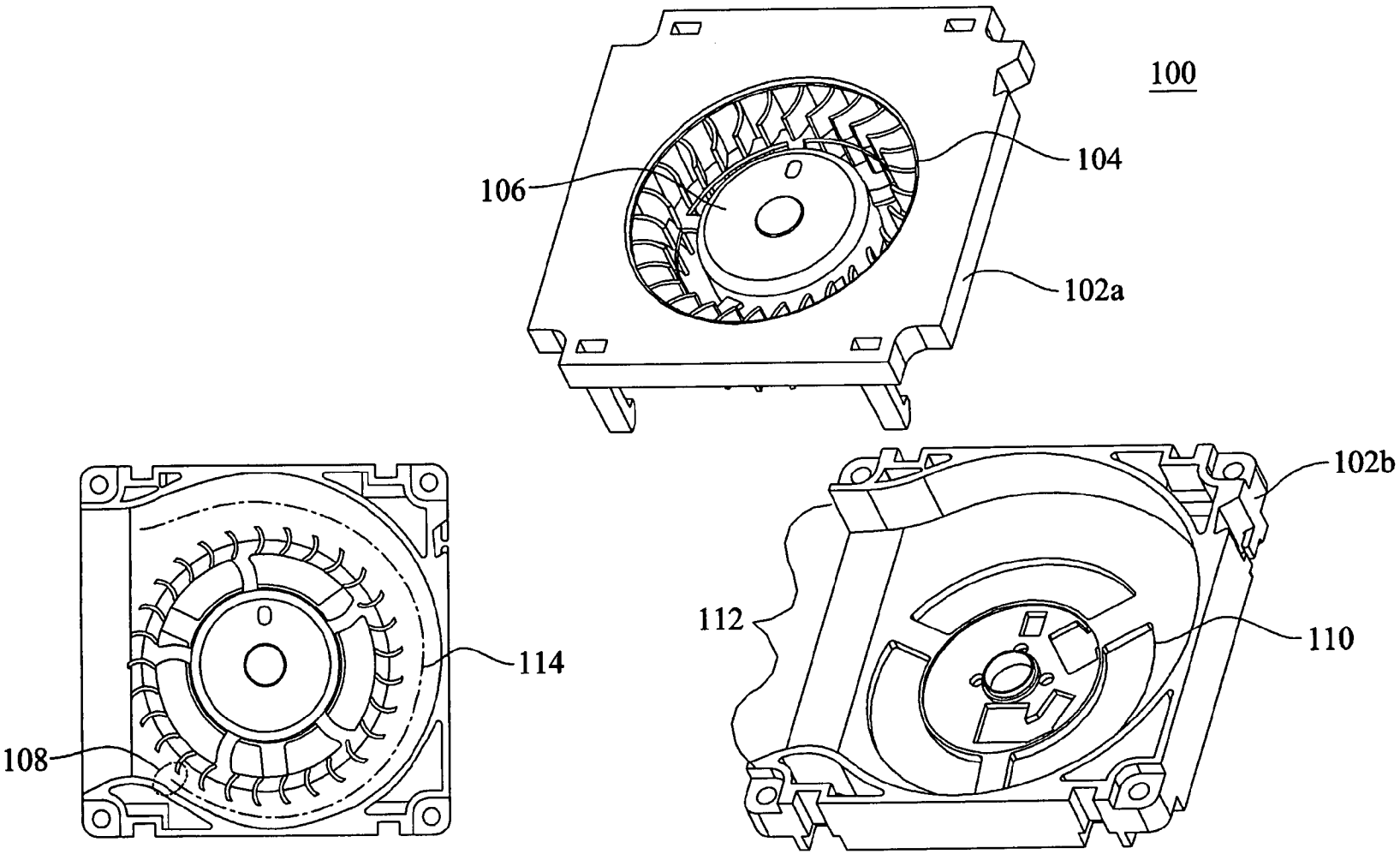
FIG. 1 (PRIOR ART)
FIG. 1 is a schematic illustration showing a conventional blower.
Figure 2:
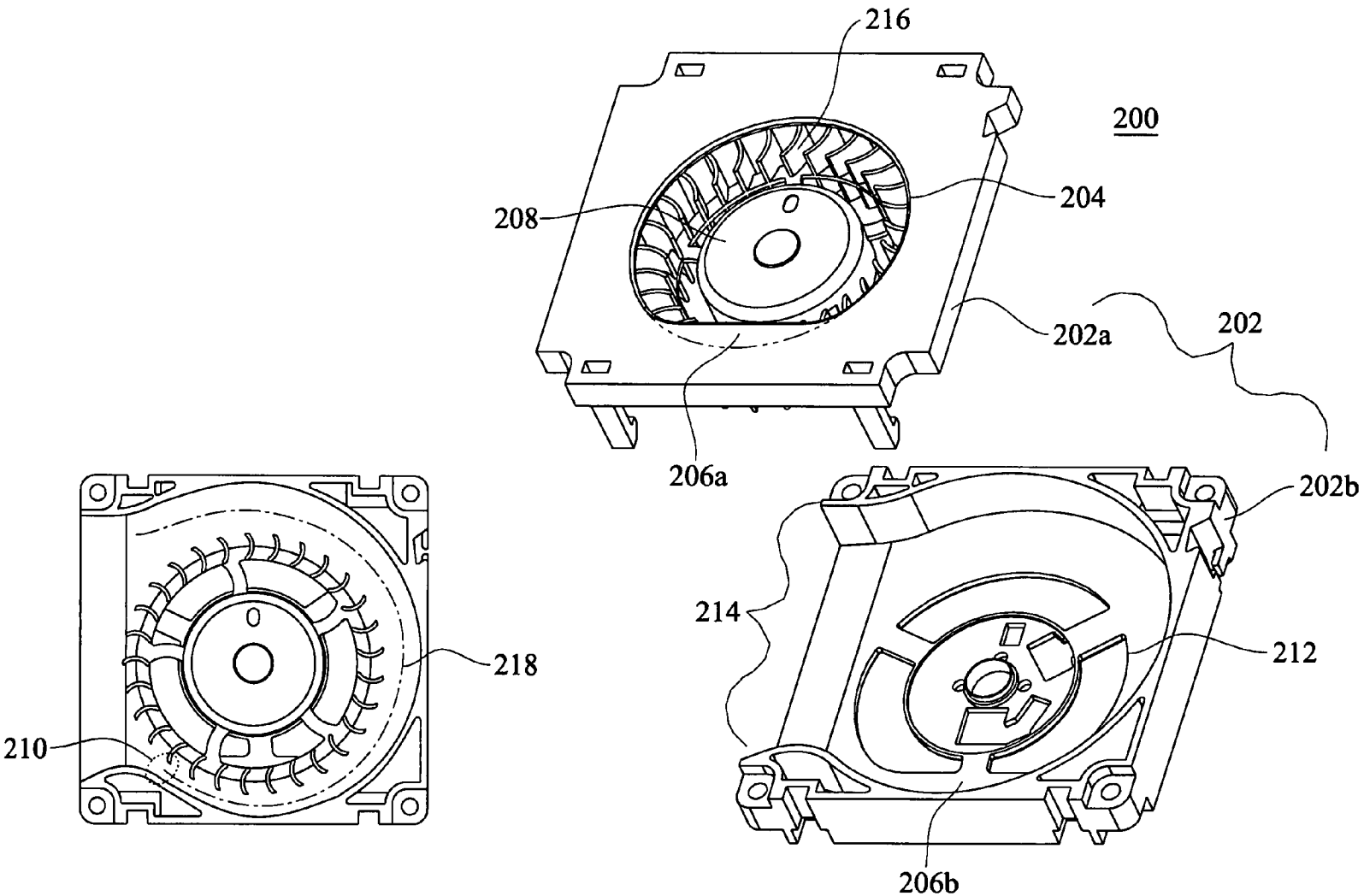
FIG. 2 is a schematic illustration showing a side-blown fan in accordance with a preferred embodiment of the invention, wherein the protrusion is a chord edge.

A side-blown fan of the invention will be described in the form of a blower. Referring to FIG. 2, a side-blown fan 200 of the invention is formed by a case 202 and a blade member 208, wherein a high air pressure region 210 exists between the blade member 208 and the case 202.

The case 202 has a side-outlet 214, axial inlets 204 and 212, and protrusions 206*a* and 206*b*. The protrusions 206*a* and 206*b* extend from edges of the axial inlets 204 and 212 toward the centers of the axial inlets 204 and 212, respectively. The axial inlets 204 and 212 correspond to each other, and the protrusions 206*a* and 206*b* also correspond to each other. The case 202 is made from, for example, a plastic, metallic or composite material. Also, the case 202 can be formed by way of injection molding, press forming, cutting, or the like. In one embodiment, case elements 202*a* and 202*b* are formed by way of injection molding and then combined. In addition, each of the axial inlets 204 and 212 may be shaped to be substantially circular.

The case elements 202*a* and 202*b* may be combined by way of clamping, riveting, engaging, adhering, or the like. Specifically, the case element 202*a* has extending hooking structures and the case element 202*b* has corresponding eye structures so that the hooking structures and the eye structures are engaged to combine the case elements 202*a* and 202*b*. Alternatively, in another embodiment, the case element 202*a* has extending U-shaped structures and the case element 202*b* has corresponding bump structures so that the U-shaped structures and the bump structures are engaged to combine the case elements 202*a* and 202*b*.

The blade member 208 is embedded inside the case 202, and has a plurality of blades 216 and a driving device (not shown) for driving the blades 216. In the radial direction, a flow field 218 exists between the blade member 208 and the case 202, wherein there is a high air pressure region 210 in the flow field 218. The high air pressure region 210 means a narrower region existing between the blade member 208 and the case 202 in the radial direction. Specifically, the high air pressure region 210 is a flow region extending from the narrowest section of the flow field 218 to a section at a prescribed distance of the flow field 218 along the direction of the operational air stream inside the case 202. The prescribed distance depends on requirements in actual practice.

The protrusions 206*a* and 206*b* cover the high air pressure region 210 and a part of the blade member 208, wherein the range of the specific region varies according the required air pressure. The protrusion 206*a* (or 206*b*), as shown in FIG.

Figure 3:
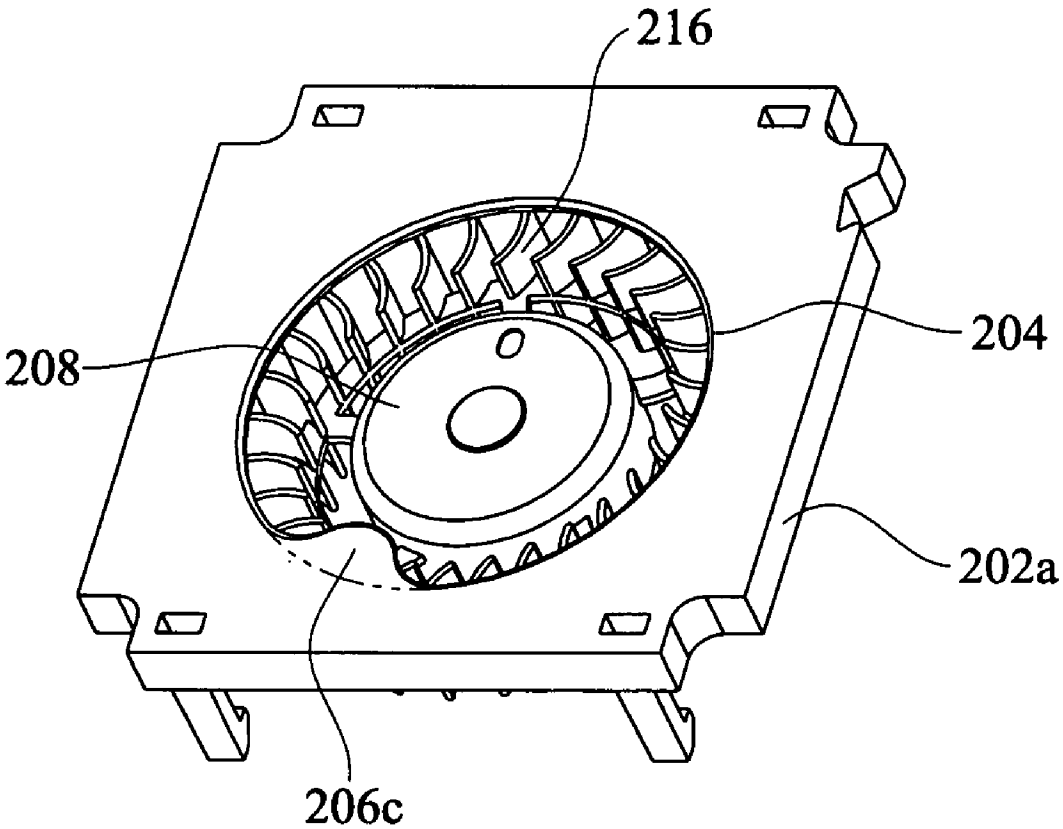
FIG. 3 is a schematic illustration showing a part of a side-blown fan in accordance with a preferred embodiment of the invention, wherein the protrosion is a bump.

2, can be a chord edge of the circular axial inlets 204 (or 212). Alternatively, the protrusion can be a bump 206*c* as shown in FIG. 3.

In the side-blown fan 200, the high air pressure region 210 covered by the protrusions 206*a* and 206*b* exists between the axial inlets 212 and 204. Accordingly, when the overflowing air pressure is reached, the operational air stream will be blocked by the protrusions 206*a* and 206*b* and still flow within the flow field 218, thereby preventing the air leakage. Therefore, a higher operational air pressure can be obtained under the same rotating speed, and even the rotating speed of the fan may be further increased to get a higher operational air pressure.

Figure 4:
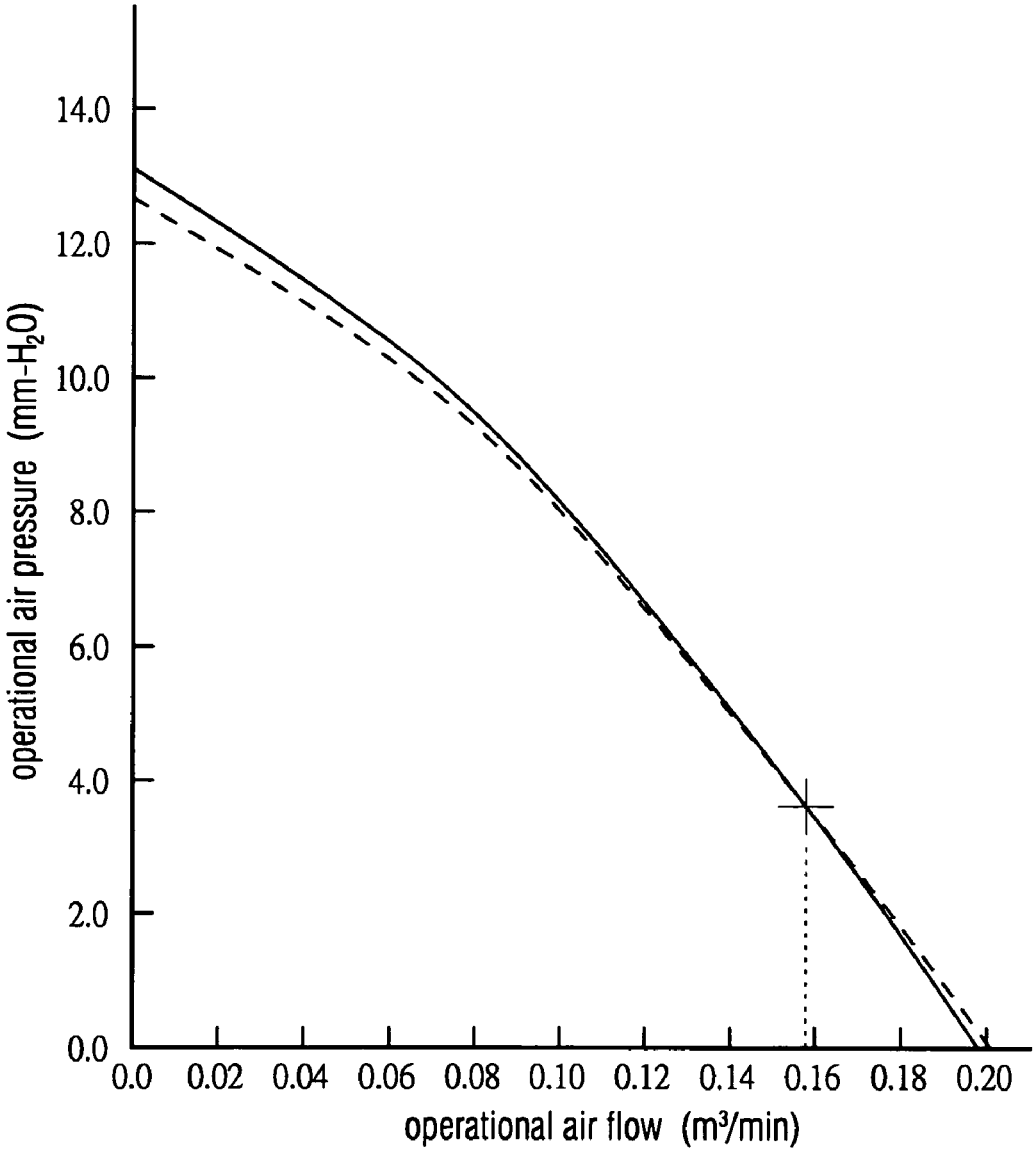
FIG. 4 is a graph showing curves of airflow versus air pressure of the side-blown fan in accordance with the preferred embodiment of the invention and a conventional blower.

Next, the effect of the side-blown fan of the invention will be described with reference to FIG. 4, which shows curves of air flow vs. air pressure of the side-blown fan according to the preferred embodiment of the invention and a conventional blower. Referring to FIG. 4, the solid line represents a curve of air flow vs. air pressure of the side-blown fan in accordance with the preferred embodiment of the invention, while the dashed line represents a curve of air flow vs. air pressure of the conventional blower.

It can be seen from FIG. 4 that when the required air flow is smaller than about 0.158 $m^3$/min (indicated by a symbol "+" in the drawing), the operational air pressure of the side-blown fan of the invention is higher than that of the conventional blower. When the operational airflow is getting smaller and smaller, the operational air pressure of the side-blown fan of the invention may be significantly increased.

In the side-blown fan of the invention, since the protrusion covers the high air pressure region 210 and a part of the blade member 208, when the side-blown fan is in operation, the air traveling within the flow field of the side-blown fan will not overflow from the flow field, and the operational air pressure can be greatly increased.

In addition, in the side-blown fan of the invention, since the protrusion extends from the edge of the axial inlet toward the center, the dimension of the axial inlet is slightly reduced. However, the operational air pressure may be greatly increased within the range of the specific airflow.

Moreover, although the case 202 in accordance with the embodiment of the invention is formed by combining at least two case elements, the case 202 may also be integrally formed.

Furthermore, although the case 202 of the invention has two axial inlets in accordance with the embodiment, the case 202 may have only one axial inlet.

While the invention has been described by way of an example and in terms of a preferred embodiment, it is to be understood that the invention is not limited to the disclosed embodiment. To the contrary, it is intended to cover various modifications. Therefore, the scope of the appended claims should be accorded the broadest interpretation so, as to encompass all such modifications.

What is claimed is:

1. A side-blown fan comprising:

a case having a side-outlet, a first axial inlet, and a first protrusion extending from an edge of the first axial inlet toward the center of the first axial inlet; and a blade member embedded inside the case, wherein a high air pressure region exists between the blade member and the case in a radial direction, the first protrusion covers the high air pressure region and a part of the blade member, and the first protrusion is a chord edge or a bump of the first axial inlet.

2. The side-blown fan according to claim 1, further comprising a flow field region between the case and the blade member.

3. The side-blown fan according to claim 2, wherein the high air pressure region is a region extending from the narrowest section of the flow field region to a section at a prescribed distance along the direction of the operational air stream inside the case.

4. The side-blown fan according to claim 1, wherein the high air pressure region means a narrow region existing between the blade member and the case in the radial direction.

5. The side-blown fan according to claim 1, wherein the case is constituted of a plurality of case elements.

6. The side-blown fan according to claim 5, wherein the plurality of case elements are jointed by a method selected from the group consisting of fixing, riveting, fastening and adhering.

7. The side-blown fan according to claim 5, wherein the plurality of case elements are jointed by engaging hooking structures and corresponding eye structures formed on the case elements, respectively; or the plurality of case elements are jointed by engaging U-shaped structures and corresponding bump structures formed on the case elements, respectively.

8. The side-blown fan according to claim 1, wherein the case further comprises a second axial inlet, and a second protrusion extending from an edge of the second axial inlet toward the center of the second axial inlet.

9. The side-blown fan according to claim 8, wherein the second axial inlet corresponds to the first axial inlet, and the second protrusion corresponds to the first protrusion.

10. The side-blown fan according to claim 8, wherein the second protrusion is a chord edge or a bump of the second axial inlet.

11. A side-blown fan comprising:

a ease having a side-outlet and a plurality of axial inlets; and a blade member embedded inside the case, wherein a high air pressure region exists between the blade member and the case in a radial direction, and each axial inlet has a protrusion extending from an edge of the axial inlet close to the high air pressure region toward the center of the axial inlet.

12. The side-blown fan according to claim 11, wherein the protrusion covers the high air pressure region and a part of the blade member.

13. The side-blown fan according to claim 11, further comprising a flow field region between the case and the blade member.

14. The side-blown fan according to claim 13, wherein the high air pressure region is a region extending from the narrowest section of the flow field region to a section at a prescribed distance along the direction of the operational air stream inside the case.

15. The side-blown fan according to claim 11, wherein the high air pressure region is a narrow region existing between the blade member and the case in the radial direction.

16. The side-blown fan according to claim 11, wherein the case is constituted of a plurality of case elements.

17. The side-blown fan according to claim 16, wherein the plurality of case elements are jointed by a method selected from the group consisting of fixing, riveting, fastening and adhering.

18. The side-blown fan according to claim 16, wherein the plurality of case elements are jointed by engaging hooking structures and corresponding eye structures formed on the case elements, respectively; or the plurality of case elements are jointed by engaging U-shaped structures and corresponding bump structures formed on the case elements, respectively.

19. The side-blown fan according to claim 11, wherein each protrusion is a chord edge or a bump of each axial inlet.

* * * * *